US006977639B2

(12) United States Patent
Fujiwara et al.

(10) Patent No.: US 6,977,639 B2
(45) Date of Patent: Dec. 20, 2005

(54) DRIVING METHOD OF DISPLAY DEVICE AND DISPLAY DEVICE USING THEREOF

(75) Inventors: Koji Fujiwara, Tenri (JP); Tomohiko Yamamoto, Nara (JP); Keiichi Tanaka, Tenri (JP); Naoto Inoue, Shiki-gun (JP); Hideki Ichioka, Nabari (JP)

(73) Assignee: Sharp Kabushiki Kaisha, Osaka (JP)

( * ) Notice: Subject to any disclaimer, the term of this patent is extended or adjusted under 35 U.S.C. 154(b) by 252 days.

(21) Appl. No.: 10/270,195

(22) Filed: Oct. 15, 2002

(65) Prior Publication Data

US 2003/0080951 A1 May 1, 2003

(30) Foreign Application Priority Data

Oct. 26, 2001 (JP) ..... 2001-329816

(51) Int. Cl.[7] ..... G09G 3/36
(52) U.S. Cl. ..... 345/94; 345/99
(58) Field of Search ..... 345/55, 92, 204, 345/213, 94, 99

(56) References Cited

U.S. PATENT DOCUMENTS 6,795,066 B2 * 9/2004 Tanaka et al. ..... 345/204

FOREIGN PATENT DOCUMENTS

| | | |
|---|---|---|
| JP | 50573/1985 | 4/1985 |
| JP | 01-188181 | 7/1989 |
| JP | 342148/1994 | 12/1994 |
| JP | 09-204159 | 8/1997 |
| JP | 10489/1998 | 1/1998 |
| JP | 2001-042282 | 2/2001 |
| JP | 2001-051254 | 2/2001 |
| JP | 2001-184015 | 7/2001 |
| JP | 2001-228457 | 8/2001 |
| JP | 2001-281625 | 10/2001 |
| JP | 2001-282163 | 10/2001 |

OTHER PUBLICATIONS

U.S. Appl. No. 09/856,926, filed May 2001, Tsuda et al.
Notice of Reasons for Refusal (and English translation) for 2001-329816 (Jul. 25, 2005), Japan.

* cited by examiner

*Primary Examiner*—Richard Hjerpe
*Assistant Examiner*—Rodney Amadiz
(74) *Attorney, Agent, or Firm*—Nixon & Vanderhye, P.C.

(57) ABSTRACT

A display device is arranged in such a manner that rows on the screen on which pixel electrodes are provided in a matrix manner are sequentially selected so as to be scanned by scanning signal lines formed on a substrate, and a data signal is supplied from gray scale signal lines, which are formed on a counter substrate facing the substrate, to the pixel electrodes on the selected row, so that the display is carried out. Also, an idle period, (i) which is longer than a scanning period for scanning the screen once and (ii) during which period all scanning signal lines are in the state of non-scanning, is provided, and the scanning period and the idle period constitute one vertical period. With this arrangement, it is possible to (1) provide a driving method of a display device by which method the reduction of power consumption is sufficiently realized without causing the degradation of the display qualities, and (2) provide a display device using the same.

10 Claims, 9 Drawing Sheets

DRIVING METHOD OF DISPLAY DEVICE AND DISPLAY DEVICE USING THEREOF

FIELD OF THE INVENTION

The present invention relates to an active matrix display device achieving low power consumption.

BACKGROUND OF THE INVENTION

Liquid crystal display devices (LCD devices) have such advantages as a possibility of remarkably reduced thickness, low power consumption, and facility for full-colorizing, compared with other display devices such as CRTs (Cathode Ray Tubes).

With these advantages, LCD devices have recently been used for various types of apparatuses such as mobile phones, notebook-sized computers, portable TVs, and digital video cameras.

Among the LCD devices, active matrix LCD devices such as TFT (Thin Film Transistor) -LCD devices have been in the dominant position thanks to their quick responsiveness and high display qualities.

As the demand for active matrix LCD devices increases, the performance requirement for the same has become higher year by year. Above all things, there has been a great deal of interest in reducing the power consumption of active matrix LCD devices.

Actually, the power consumption of active matrix LCD devices is an important factor in designing rapid-growing portable devices like mobile phones and PDAs (Personal Digital Assistants), so that the reduction of the power consumption of active matrix LCD devices is urgently needed.

Methods of the reduction of the power consumption and the improvement of the display qualities have been actively researched. For instance, such methods of reducing the power consumption are explained in publications including Japanese Laid-Open Utility Model Application No. 60-50573/1985 (Jitsukaisho 60-50573; published on Apr. 9, 1985) and Japanese Laid-Open Patent Application No. 10-10489/1998 (Tokukaihei 10-10489; published on Jan. 16, 1998). These publications focus on the method of transmitting a television signal, so that, utilizing a vertical blanking interval during which period no data exists, the reduction of the power consumption is achieved by stopping the operation of peripheral drive circuits during a vertical blanking interval.

This vertical blanking interval is originally provided as a period during which period an electron beam from the electron gun inside a CRT returns to a previous position, so as not to be required in LCD devices at all. However, for receiving a television signal such as NTSC on the occasion of displaying normal televisual images, LCD devices are also provided with the vertical blanking interval.

An alternative method of reducing the power consumption is explained in Japanese Laid-Open Patent Application No. 6-342148/1994 (Tokukaihei 6-342148; published on Dec. 13, 1994), wherein ferroelectric liquid crystal which functions as a memory is utilized for a liquid crystal panel so that the refresh rate is reduced.

However, the conventional methods disclosed by the above-referenced publications have problems as follows.

In the case of the method of stopping the operation of peripheral drive circuits during the vertical blanking interval disclosed by Japanese Laid-Open Utility Model Application No. 60-50573/1985 and Japanese Laid-Open Patent Application No. 10-10489/1998, as the former publication suggests, the vertical blanking interval is only around 8% of the total time and hence merely 5% of the electric power can be saved in the interval.

In the method disclosed by Japanese Laid-Open Patent Application No. 6-342148/1994, the ferroelectric liquid crystal is basically for binary (black and white) display so as not to allow gray scale display, and hence it is not possible to display realistic images. Moreover, since the production of ferroelectric liquid crystal display panels requires highly advanced techniques, practical use thereof has not been realized yet.

As just described, conventional driving methods of active matrix LCD devices hardly achieve the reduction of the power consumption, while keeping basic display qualities such as brightness, contrast, responsiveness, and gray scale property.

SUMMARY OF THE INVENTION

The main objectives of the present invention are to provide a driving method of a display device by which method the reduction of power consumption is sufficiently realized, and to provide a display device using the same.

To achieve the above-identified objectives, the driving method of the display device in accordance with the present invention includes the steps of: sequentially scanning rows on a screen on which pixels are provided in a matrix manner, by scanning signal lines formed on a substrate; and supplying a data signal to pixels on a row which has been selected, from data signal lines formed on a counter substrate which faces the substrate, wherein, a first idle period (i) which is longer than a data write period for scanning the screen once and (ii) during which period all scanning signal lines are in a state of non-scanning, is provided, and the data write period and the idle period constitute one vertical period.

Moreover, the display device in accordance with the present invention includes: pixel electrodes provided in a matrix manner; switching elements connected to the respective pixel electrodes; a substrate on the side of the switching elements, on which scanning signal lines which control the switching elements by scanning so as to select the pixel electrodes are provided; and a counter substrate which faces the substrate via a light modulating layer, on the counter substrate, data signal lines, which are for supplying a data signal to pixels corresponding to the pixel electrodes which have been selected, being provided, the display device further including: control means for establishing an arrangement such that a first idle period, (1) which is longer than a data write period for scanning all of the pixel electrodes and (2) during which period all scanning signal lines are in a state of non-scanning, is provided, and the data write period and the idle period constitute one vertical period.

According to the above-mentioned method and arrangement, the display device with the counter matrix structure, in which the data signal lines are formed on the counter substrate and the scanning signal lines and the data signal lines do not intersect with each other on the same substrate, is arranged in such a manner that a first idle period, (1) which is longer than the data write period for scanning all of the pixel electrodes and (2) during which period all scanning signal lines are in the state of non-scanning, is provided, and the data write period and the idle period constitute one vertical period.

Moreover, with the counter matrix structure, since the scanning signal lines and the data signal lines do not intersect with each other on the same substrate, the load-carrying capacitance, which is generated when the lines intersect with each other, is not generated. On this account, the load-carrying capacitance of the scanning signal lines and that of the data signal lines are small so that the signal delay is restrained.

Consequently, it is possible to shorten the scanning period in the write period for supplying the data signal, and on account of this, it is possible to extend the idle period without extending the vertical period. In other words, it is possible to make the idle period longer than the scanning period for scanning the screen once.

Since the length of one vertical period remains unchanged even if the idle period is extended, the refresh rate is not lowered. For this reason, the response to the change of the display is not slowed down and the extension of the idle period makes it possible to reduce the power consumption.

This realizes sufficient reduction of the power consumption without causing the degradation of display qualities such as brightness, contrast, and responsiveness.

Furthermore, the driving method of the display device in accordance with the present invention includes the steps of: sequentially scanning rows on a screen on which pixels are provided in a matrix manner, by scanning signal lines formed on a substrate; and supplying a data signal to pixels on a row which has been selected, from data signal lines formed on a counter substrate which faces the substrate, wherein, a first idle period, (I) which is longer than a data write period for scanning the screen once and (II) during which period all scanning signal lines are in a state of non-scanning, and the data write period, during which period one of the scanning lines is in a state of scanning, are alternately provided, and the scanning periods and the idle period constitute one vertical period.

Furthermore, the display device in accordance with the present invention includes: pixel electrodes provided in a matrix manner; switching elements connected to the respective pixel electrodes; a substrate on the side of the switching elements, on which scanning signal lines which control the switching elements by scanning so as to select the pixel electrodes are provided; and a counter substrate which faces the substrate via a light modulating layer, on the counter substrate, data signal lines, which are for supplying a data signal to pixels corresponding to the pixel electrodes which have been selected, being provided, the display device further including: control means for establishing arrangements such that the data write period, during which period one of the scanning signal lines is always in a state of scanning, and first idle period, during which period all of the scanning signal lines are in a state of non-scanning, are alternately provided, and the data write period and the idle period constitute one vertical period.

Furthermore, the display device in accordance with the present invention includes: pixel electrodes provided in a matrix manner; switching elements connected to the respective pixel electrodes; a substrate on the side of the switching elements, on which scanning signal lines which control the switching elements by scanning so as to select the pixel electrodes are provided; and a counter substrate which faces the substrate via a light modulating layer, on the counter substrate, data signal lines, which are for supplying a data signal to pixels corresponding to the pixel electrodes which have been selected, being provided, the display device further including: control means for establishing arrangements such that scanning periods, during which periods one of the scanning signal lines is always in a state of scanning, and idle periods, during which periods all of the scanning signal lines are in a state of non-scanning, are alternately provided, and the scanning periods and the idle periods constitute one vertical period.

According to the above-mentioned method and arrangement, in the data write period, for instance, each of the idle periods corresponds to each scanning of a row.

On this account, it is possible to extend the idle periods in total without extending the vertical period, i.e. it is possible to make the idle periods longer than the scanning periods for scanning the screen once. Also, since the length of one vertical period remains unchanged even if the idle period is extended, the refresh rate is not lowered, and hence the idle periods can be provided without lowering the refresh rate from a regular rate (50–70 Hz, for instance) at all.

This makes it possible to realize the reduction of the power consumption without causing the degradation of moving image qualities, i.e. with no reduction of the display qualities.

Furthermore, the driving method of the display device in accordance with the present invention includes the steps of: sequentially scanning rows on a screen on which pixels are provided in a matrix manner, by scanning signal lines formed on a substrate; and supplying a data signal to pixels on a row which has been selected, from data signal lines formed on a counter substrate which faces the substrate, wherein, when supply frequency of the data signal is N(Hz) and j scanning signal lines are provided, during a period of $1/(N \cdot j)$ (second), the data signal is supplied to the pixels, which are on the row which has been selected, more than once.

Furthermore, the display device in accordance with the present invention includes: pixel electrodes provided in a matrix manner; switching elements connected to the respective pixel electrodes; a substrate on the side of the switching elements, on which scanning signal lines which control the switching elements by scanning so as to select the pixel electrodes are provided; and a counter substrate which faces the substrate via a light modulating layer, on the counter substrate, data signal lines, which are for supplying a data signal to pixels corresponding to the pixel electrodes which have been selected, being provided, the display device further including: control means for controlling the scanning signal lines and the data signal lines in order to establish an arrangements such that, when supply frequency of the data signal is N(Hz) and j scanning signal lines are provided, during a period of $1/(N \cdot j)$ (second), the data signal is supplied to the pixels, which have been selected by the scanning signal lines, more than once.

According to the above-mentioned method and arrangement, scanning the display more than once in the period of $1/(N \cdot j)$ (second) enables to write the same image more than once.

That is to say, the write periods are repeated more than once within the period of $1/(N \cdot j)$ (second), and thus the time for keeping a voltage (light modulating layer voltage) to be supplied to the light modulating layer is shortened.

This results in the prevention of the degradation of display qualities (such as generation of flicker) due to the decrease of the rate of keeping the light modulating layer voltage. On this account, it is possible to, for instance, improve the display qualities of the display device.

For a fuller understanding of the nature and advantages of the invention, reference should be made to the ensuing detailed description taken in conjunction with the accompanying drawings.

BRIEF DESCRIPTION OF THE DRAWINGS

FIG. 5(*b*) indicates a signal waveform of the scanning signal shown in FIG. 5(*a*), after the signal is supplied to the LCD device with the counter matrix structure.

FIG. 5(*c*) indicates a signal waveform of the scanning signal shown in FIG. 5(*a*), after the signal is supplied to the LCD device of the comparative example.

FIG. 6(*b*) is a signal waveform of the data signal shown in FIG. 6(*a*), after the signal is supplied to the LCD device with the counter matrix structure.

FIG. 6(*c*) indicates a signal waveform of the data signal shown in FIG. 6(*a*), after the signal is supplied to the LCD device of the comparative example.

FIG. 8(*b*) is an enlarged view of the write period in the LCD device illustrated in FIG. 8(*a*).

DESCRIPTION OF THE EMBODIMENTS

[Embodiment 1]

The following description will discuss an embodiment of a display device in accordance with the present invention in reference to FIGS. 1–7 and 17.

Figure 2:
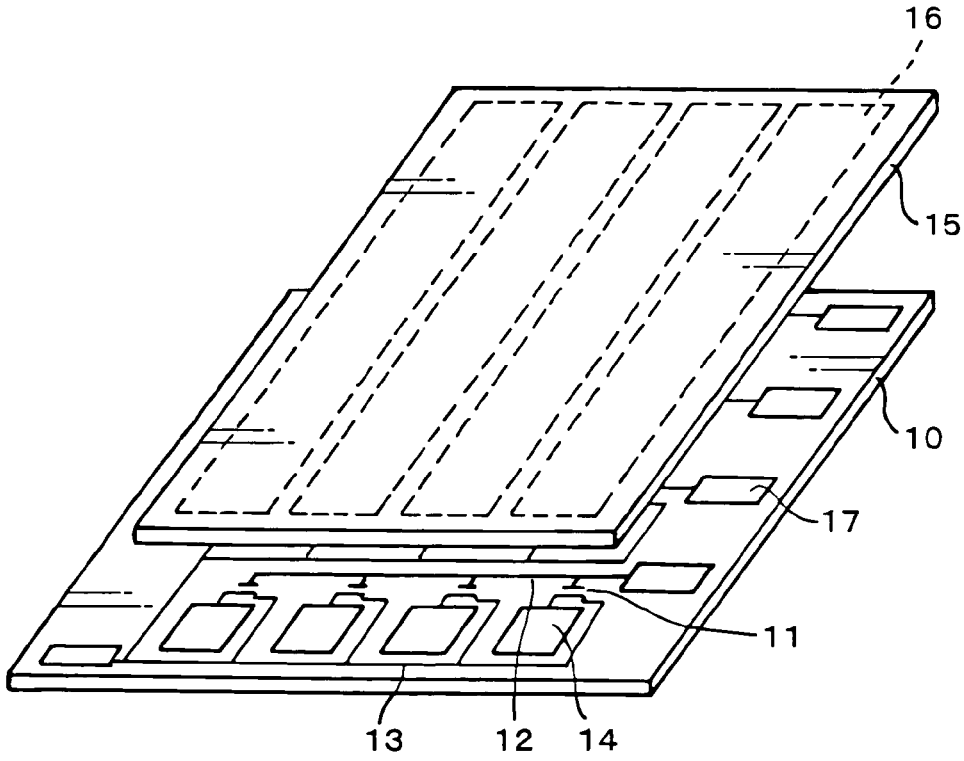
FIG. 2 illustrates an arrangement of an important part of the LCD device shown in FIG. 1.

As illustrated in FIG. 2, an LCD device (display device) in accordance with the present embodiment is provided with: a substrate (substrate on the side of switching elements) 10; TFTs (Thin Film Transistors: switching elements) 11; scanning signal lines 12; reference signal lines 13; pixel electrodes 14; a counter substrate 15; and gray scale signal lines (data signal lines) 16, wherein a structure on which the gray scale signal lines 16 are provided on the side of the counter substrate 15 (hereinafter, will be simply referred to as counter matrix structure) is adopted.

Moreover, color filter layer (not illustrated) for color display is provided on the counter substrate 15. The color filter layer, for instance, consists of R (Red), G (Green) and B (Blue) colors.

The location and colors of the color filter layer are not limited to the above-mentioned arrangement, and hence the color filter layer may be provided on the substrate 10, and may have a black matrix.

The substrate 10 and the counter substrate 15 are provided so as to face each other via a liquid crystal layer (light modulating layer) which is not illustrated in the figure. Also, orientational films (not illustrated) are provided on (i) the surface, facing the liquid crystal layer, of the substrate 10 and (ii) the surface, facing the liquid crystal layer, of the counter substrate 15, respectively.

The liquid crystal layer is formed in such a way that the substrate 10 and the counter substrate 15 are glued together using a sealing agent and then liquid crystal (light modulating material) is poured into the space between the substrate 10 and the counter substrate 15.

The substrate 10 is made of, for instance, glass, and has light-transparency. On the substrate 10, the pixel electrodes 14 are provided in a matrix manner, and each of the pixel electrodes 14 is provided with the TFT 11. The TFTs 11 are also provided in a matrix manner in accordance with the respective pixel electrodes 14.

The scanning signal lines 12 are provided in parallel with the reference signal lines 13, and connected to respective drive circuits 17. In other words, each of the scanning signal lines 12 is independently controlled. The drive circuits 17 are connected to a gate driver which is described below.

The TFT 11 is, for instance, a switching element which has 3 terminals and is made of materials such as amorphous silicon semiconductor. The terminals of the TFT 11 are connected to the scanning signal line 12, the reference signal line 13, and the pixel electrode 14, respectively.

In other words, two neighboring TFTs 11, which are aligned in parallel to a horizontal direction (line direction) of the display screen, are arranged in such a manner that the drain electrodes (or source electrodes) of the both are connected to the respective pixel electrodes 14, and the gate electrodes of the both are both connected to the same scanning signal line 12.

Also, in the arrangement above, the source electrodes (or drain electrodes) of the respective neighboring TFTs 11 are connected to the same reference signal line 13.

On the counter substrate 15, the gray scale signal lines 16, which are data signal lines for supplying a data signal, are provided to be orthogonal to the scanning signal lines 12 provided on the side of the substrate 10. In this arrangement, a part of the gray scale signal line 16, where the line 16 faces the corresponding pixel electrode 14, functions as a counter electrode. That is to say, together with the pixel electrode 14, the part supplies a voltage to the liquid crystal layer so as to drive the liquid crystal.

Next, referring to FIG. 17, circuits for driving the LCD device will be discussed.

A scanning signal drive circuit (gate driver) 71 as a scanning signal line driver supplies a voltage (scanning signal), which corresponds to either a select period or a non-select period, to the scanning signal lines 12 of a liquid crystal panel 70 of the LCD device.

A gray scale signal/reference signal drive circuit 72 outputs a data signal to the gray scale signal lines 16 of the liquid panel 70 so as to supply the data signal (image data) to the respective pixels (pixel electrodes 14) on the scanning signal line 12 which has been selected, as a source driver which is a gray scale (data) signal line driver.

Moreover, the gray scale signal/reference signal drive circuit 72 supplies a reference signal to the reference signal lines 13.

A control circuit (control means) 75 receives image data stored in a computer, etc., supplies a gate start pulse signal GSP and a gate clock signal GCK to the scanning signal drive circuit 71, and supplies R, G, and B gray scale data, a source start pulse signal SP, a source latch strobe signal SLS, and a source clock signal SCK to the gray scale signal/reference signal drive circuit 72. All signals above are synchronized with each other. The control circuit 75 is capable of performing as control means for carrying out the driving method of the LCD device in accordance with the present embodiment.

A gray scale signal/reference signal drive power supply circuit 73, a scanning signal drive power supply circuit 74, and the control circuit 75 are connected to a power supply circuit 76 so that these circuits receive electric power from the power supply circuit 76. The gray scale signal/reference signal drive power supply circuit 73 and the scanning signal drive power supply circuit 74 supply electric power to the gray scale signal/reference signal drive circuit 72 and the scanning signal drive circuit 71, respectively. The control circuit 75 controls the power supply to the scanning signal drive circuit 71 and the gray scale signal/reference signal drive circuit 72.

Figure 17:
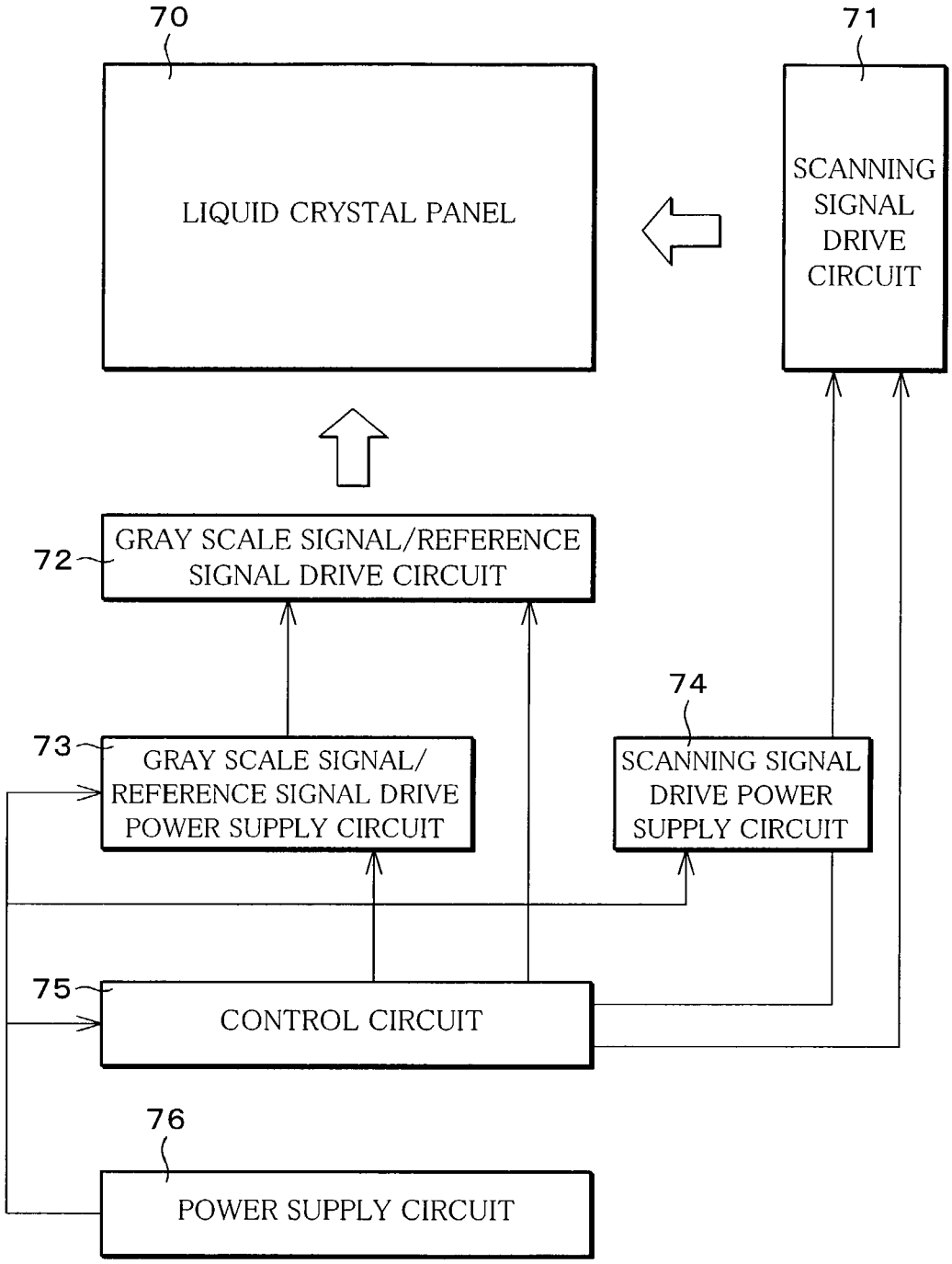
FIG. 17 is a block diagram illustrating circuits for driving an LCD device.

Referring to FIG. 2 or 17, the principles of driving the liquid crystal will be described below.

To produce a display, the LCD device is scanned by addressing the scanning signal lines 12 at a time with time-divided image data. That is to say, receiving the gate start pulse signal GSP as a cue, the scanning signal drive circuit 71 which is a gate driver starts the scanning of the liquid crystal panel 70, then following the gate clock signal GCK, the circuit 71 sequentially supplies the select voltage to the scanning signal lines 12.

For instance, when one scanning signal line 12 is horizontally scanned, a gate voltage (scanning signal) which turns the TFTs 11 to be ON-state is supplied to the scanning signal line 12. At this moment, other scanning signal lines 12 are receiving a gate voltage (scanning signal) which turns the TFTs 11 to be OFF-state.

In accordance with the source start pulse signal SP supplied from the control circuit 75 and the source clock signal SCK, the gray scale signal/reference signal drive circuit 72 as a source driver stores the supplied sets of gray scale data from the respective pixels in a register, and then in accordance with the next source latch strobe signal SLS, the circuit 72 writes the sets of gray scale data (data signal) into the respective gray scale signal lines 16 of the liquid crystal panel 70.

Moreover, in the control circuit 75, a GSP conversion circuit for setting the pulse interval of the gate start pulse signal GSP is provided. This pulse interval is, for instance, around 16.7 msec, provided that the frame frequency of the display is regular 60 Hz.

The GSP conversion circuit is capable of extending this pulse interval of the gate start pulse signal GSP to be, for instance, 167 msec. Provided that the length of the scanning period (write period) of one display is normal, around 9/10 of the pulse interval is a period during which period all of the scanning signal lines 12 are in the state of non-scanning.

As described above, in the GSP conversion circuit, it is possible to arrange the non-scanning period, which is a period from the finish of the scanning period to the re-input of the gate start pulse signal GSP to the gate driver, to be longer than the scanning period.

The scanning period and the non-scanning period are appropriately set depending on the degree of movements of displayed images such as a static image and a moving image, thus, for instance, in the GSP conversion circuit, it is possible to set a plurality of non-scanning periods in accordance with the displayed image.

In this manner, on the occasion of the horizontal scanning of one scanning signal line 12, only the TFTs 11 which are connected to the above-mentioned scanning signal line 12 which has been scanned are in the ON-state, so that the pixel voltage (reference signal) which is supplied to the reference signal line 13 is supplied to the corresponding pixel electrodes 14 of the scanning signal line 12, via the source electrodes and the drain electrodes of the respective TFTs 11. On this occasion, the electric charge of each of the pixel electrodes 14 is stored in a charge storage capacitance between the pixel electrode 14 and the counter substrate 15.

Also, a signal voltage (data signal) supplied to the respective gray scale signal lines 16 are supplied to the liquid crystal layer via the counter electrodes. In this manner, the sets of liquid crystal on the respective pixel electrodes 14 are driven on account of the potential difference (voltage applied to the liquid crystal layer) between the pixel voltage supplied to the respective pixel electrodes 14 and the signal voltage applied to the counter electrodes corresponding to the respective gray scale signal lines 16.

Incidentally, the liquid crystal layer provided in the space between the substrate 10 and the counter substrate 15 is not necessarily made of any particular materials as long as the materials are light modulating materials, and hence, for instance, the liquid crystal layer may be an EL (electroluminescence) layer. This indicates that the present embodiment can be adopted to, for instance, self-luminous elements such as organic EL display elements.

Since the LCD device adopts the counter matrix structure as described above, the scanning signal line 12 does not intersect with the corresponding gray scale signal line 16 in the pixel on either one of the substrates (the substrate 10 or the counter substrate 15), thereby it is possible to restrain the generation of a large amount of capacitance at the intersecting section of the scanning signal line 12 and the gray scale signal line 16.

On this account, it is possible to reduce the capacitance of the liquid crystal panel of the LCD device, so that the write period (scanning period) of the data can be shortened.

Figure 3:
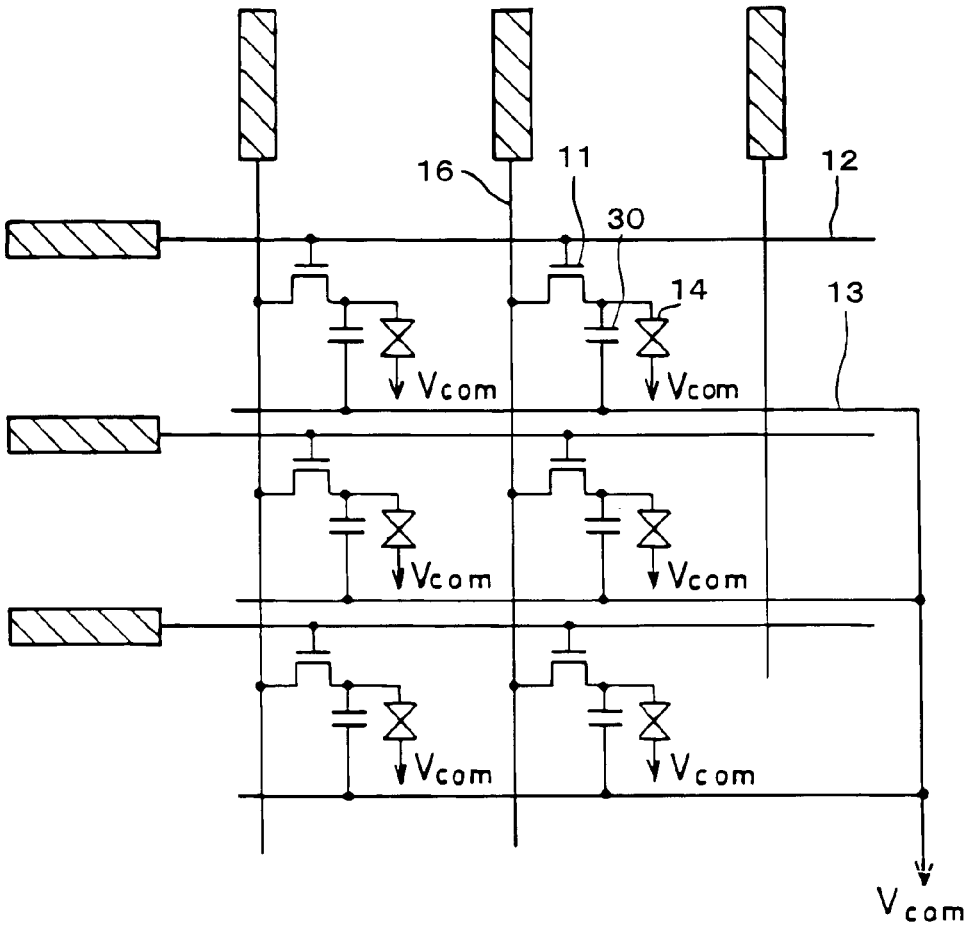
FIG. 3 illustrates an arrangement of an important part of an LCD device of a comparative example.

Now, referring to FIG. 3, the following description will discuss a comparative example of an LCD device which is arranged in such a manner that the counter matrix structure is not adopted so that the gray scale signal lines 16 are provided on the substrate on which the scanning signal lines 12 are provided, rather than on the counter substrate.

In the LCD device of the comparative example illustrated in FIG. 3, the gray scale signal lines 16 are provided on the substrate on which the scanning signal lines 12 are provided. Each of TFTs 11 is arranged in such a manner that the gate electrode is connected to the corresponding scanning signal line 12, the source electrode is connected to the corresponding gray scale signal line 16, and the drain electrode is connected to an electrode which constitutes an additional capacitance 30 together with a corresponding pixel electrode 14.

The TFTs 11 are provided in accordance with the respective pixel electrodes 14 which are formed on the substrate in a matrix manner. Also, the scanning signal lines 12 provided for respective rows intersect with the gray scale signal lines 16 provided for respective columns at right angles, and these intersecting sections are around the respective pixel electrodes 14.

In this arrangement, a scanning signal supplied via the scanning signal line 12 controls the switching of the TFT 11 corresponding to the scanning signal line 12, so that, on the occasion when the TFT 11 is turned ON, a data signal is supplied to the corresponding pixel electrode 14 via the gray scale signal line 16.

An electrode opposing the electrode connected to the drain electrode of the TFT11, via an insulating layer of an additional capacitance 30, is connected to a corresponding reference signal line 13, and the additional capacitance 30 stores a voltage supplied to the liquid crystal layer.

This additional capacitance 30 causes a signal delay due to its capacity. Thus, the reference signal lines 13 are connected to each other for reducing this signal delay.

Generally, an LCD device is arranged such that liquid crystal which is 4.3–4.5 $\mu$m thick is provided in the space between two substrates facing each other, so that a liquid crystal capacitance is formed. In the LCD device of the comparative example, the additional capacitance 30 is connected to the pixel electrode 14 in a parallel manner.

In this case, as in the description above, when the gray scale signal lines 16 and the scanning signal lines 12, which intersect each other at right angles, are provided on the same substrate, a large amount of capacitance is generated at each of the intersecting sections so that the signal delay occurs.

This load-carrying capacitance at the intersecting section is the largest among the capacitance which is the load of the signal lines 12 and 16.

Now, paying attention to the load-carrying capacitance and the driving method, the description below will discuss the difference between the LCD device of the present embodiment and the LCD device of the comparative example.

Figure 5:
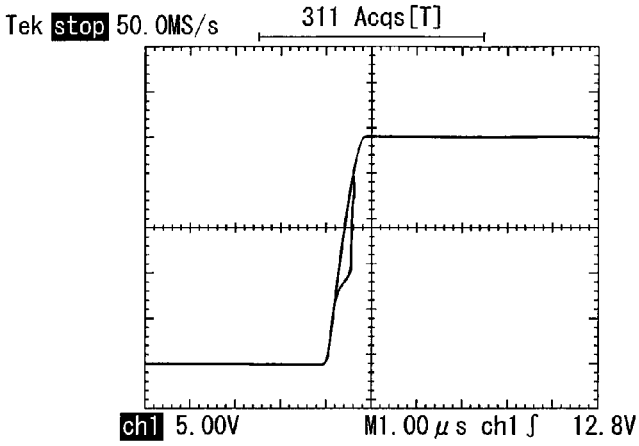
FIG. 5(*a*) indicates an input waveform of a scanning signal supplied to scanning signal lines.
Figure 5:
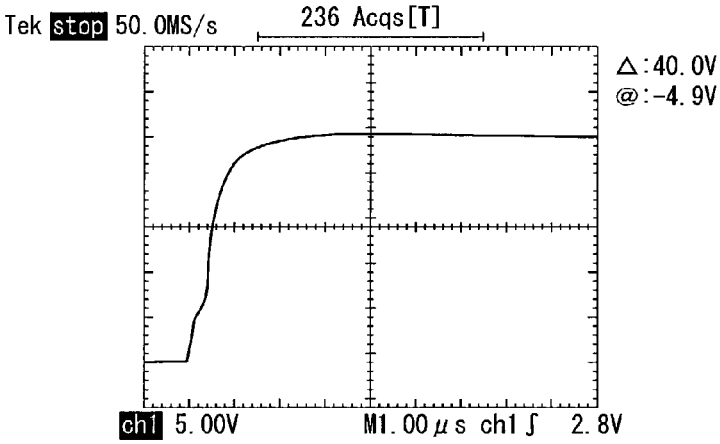
Figure 5:
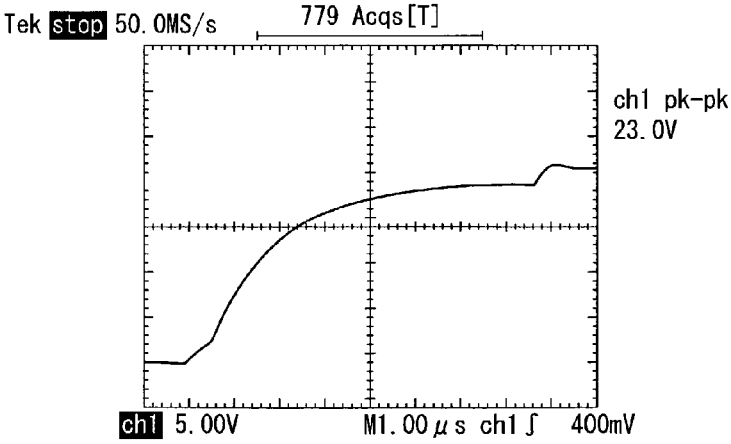

First, referring to FIGS. 5(*a*)–5(*c*) and 6(*a*)–6(*c*), the load-carrying capacitance is described.

FIG. 5(*a*) illustrates an input waveform of a scanning signal (gate voltage to be supplied) to be supplied to the scanning signal lines 12, FIG. 5(*b*) illustrates a signal waveform of the scanning signal after the same is supplied the LCD device with the counter matrix structure, and FIG. 5(*c*) illustrates a signal waveform of the scanning signal after the same is supplied to the LCD device of the comparative example.

Figure 6:
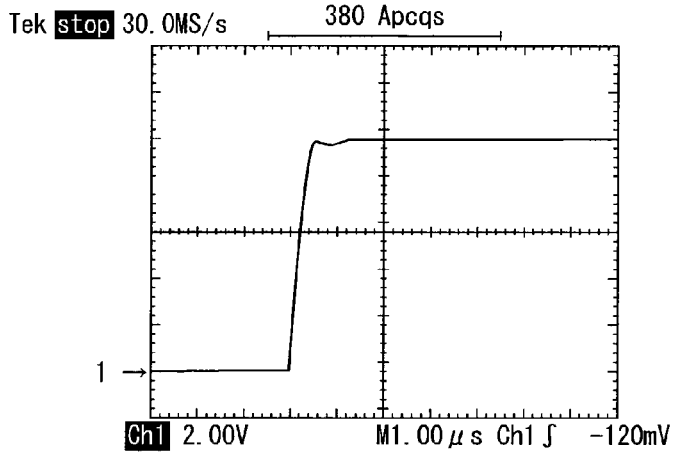
FIG. 6(*a*) is an input waveform of a data signal supplied to gray scale signal lines.
Figure 6:
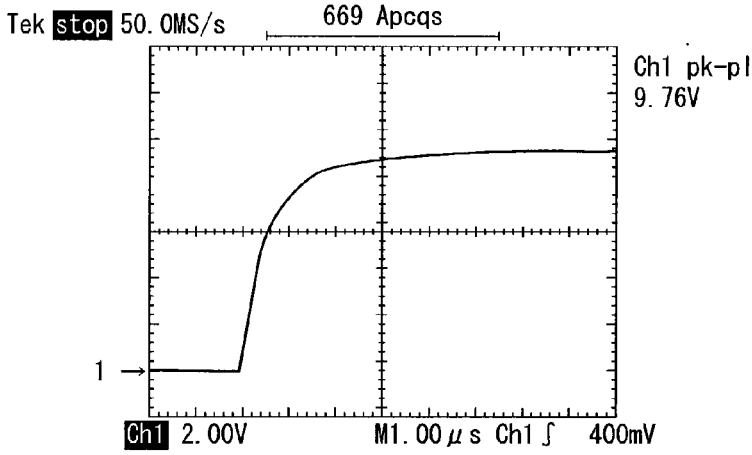
Figure 6:
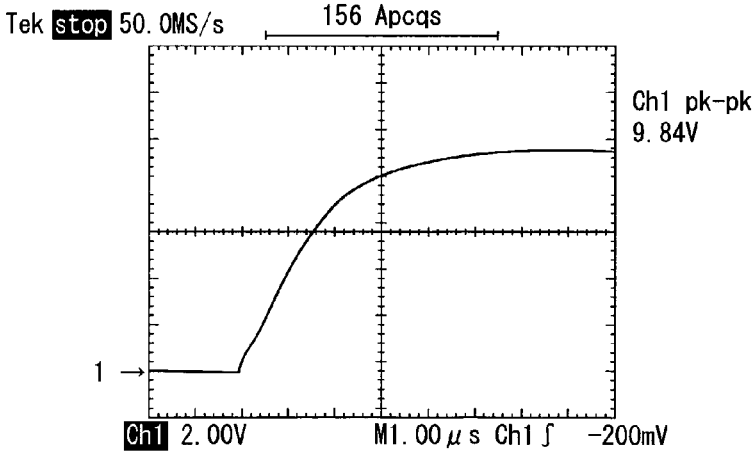

FIG. 6(*a*) illustrates an input waveform of a data signal to be supplied to the gray scale signal lines 16, FIG. 6(*b*) illustrates a signal waveform of the data signal after the same is supplied the LCD device with the counter matrix structure, and FIG. 6(*c*) illustrates a signal waveform of the data signal after the same is supplied to the LCD device of the comparative example.

Here, all of the signal lines, namely the scanning signal lines 12 and the gray scale signal lines 16 of the LCD device with the counter matrix structure and the lines 12 and 16 of the LCD device of the comparative example, have substantially the same resistance. On this account, the comparison between signal delays (time constant (Tg)) of the respective signal lines proves the difference between the load-carry capacitance of the respective signal lines (such as the scanning signal lines 12 and the gray scale signal lines 16).

The waveforms of the supplied signals, which are illustrated in FIGS. 5(*b*), 5(*c*), 6(*b*), and 6(*c*), are measured at the non-input ends of the signals.

The signal delay of the scanning signal supplied to the scanning signal lines 12 in the case of the LCD device with the counter matrix structure is $\tau g=0.65$ ($\mu$s), whereas the signal delay of the scanning signal supplied to the scanning signal lines 12 in the case of the LCD device of the comparative example is $\tau g=3.0$ ($\mu$s).

In this manner, compared to the LCD device of the comparative example (the scanning signal lines 12 and the gray scale signal lines 16 are provided on the same substrate), the signal delay with respect to the scanning signal lines 12, i.e. the load-carrying capacitance was around ⅕ in the LCD device with the counter matrix structure.

The signal delay of the data signal supplied to the gray scale signal line 16 in the case of the LCD device with the counter matrix structure is $\tau g=0.6$ ($\mu$s), whereas the signal delay of the data signal supplied to the gray scale signal line 16 in the case of the LCD device of the comparative example is $\tau g=1.8$ ($\mu$s).

In this manner, compared to the LCD device of the comparative example (the scanning signal lines 12 and the gray scale signal lines 16 are provided on the same substrate), the signal delay with respect to the gray scale signal lines 16, i.e. the load-carrying capacitance was around ⅓ in the LCD device with the counter matrix structure.

According to the results of the measurements above, the respective comparisons between FIGS. 5(*a*) and 5(*b*), 5(*a*) and 5(*c*), 6(*a*) and 6(*b*), and 6(*a*) and 6(*c*) clearly show that the load-carrying capacitance in the LCD device with the counter matrix structure is smaller than the same in the LCD device of the comparative example, so that the signal delay in the former LCD device is smaller than the same in the latter LCD device. On this account, the write period in the LCD device with the counter matrix structure is shorter than the write period of the CLD device of the comparative example, even if the both LCD devices are provided with the same amount of data.

Next, referring to FIGS. 1, 4, and 7, a write period and a first idle period concerning the drive of an LCD device (driving method) will be discussed below.

Figure 1:
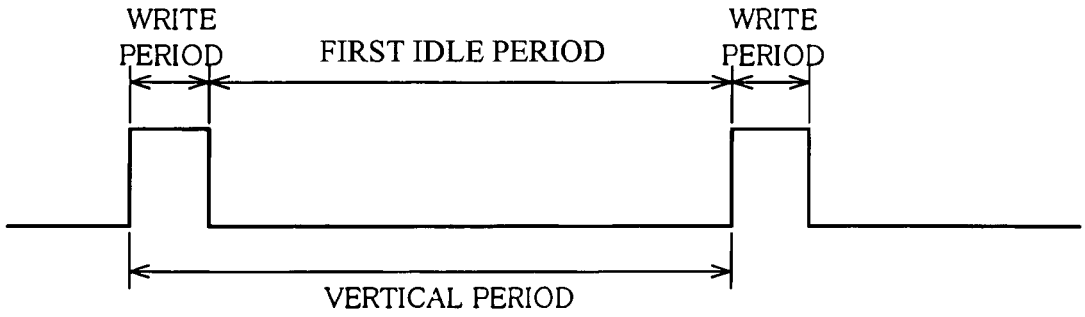
FIG. 1 illustrates a driving method of an LCD device with a counter matrix structure in accordance with an embodiment of the present invention.
Figure 4:
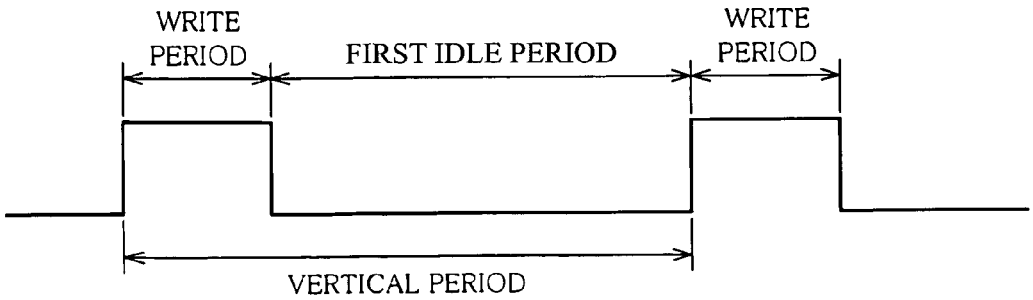
FIG. 4 illustrates a driving method of the LCD device of the comparative example shown in FIG. 3.

FIG. 1 illustrates a driving method of the LCD device with the counter matrix structure, and FIG. 4 illustrates a driving method of the LCD device of the comparative example.

As shown in FIG. 4, the LCD device of the comparative example is arranged in such a way that a write period (data signal is supplied to the pixel electrodes 14 which have been selected) for scanning the screen once is followed by a first idle period during which period the drive of scanning signal lines 12 and the supply of the data signal are stopped (the scanning signal lines 12 are brought to be the state of non-scanning). Here, the write period (data write period) and the first idle period constitute a vertical period (one vertical period).

To put it differently, the cycle of the display operation which is repeatedly carried out is arranged such that, after writing an image into the screen, the first idle period starts while the screen is kept in the same state, and after a predetermined length of first idle period is elapsed, an image is written into the screen again.

As described above, despite having the same amount of data, the write period of the LCD device with the counter matrix structure is shorter than the write period of the LCD device of the comparative example.

Thus, when the amount of image data is the same, the data write period (write period) in FIG. 1, which is a scanning period, is shorter than the write period shown in FIG. 4. On this account, it is possible to increase the first idle period as the write period is decreased.

That is to say, it is possible to provide the first idle period which is a non-scanning period longer than the scanning period for scanning the screen once and able to cause all of the scanning signal lines to be in the state of non-scanning.

Generally, if the write period has the same length, the longer idle period results the longer vertical period and the less refresh rate of the screen, i.e. the drive frequency goes higher. On this account, the response rate to the change of the display becomes lower.

In contrast, the shorter the idle period, the shorter the vertical period has become so that the power consumption increases.

Thus, provided that driving with the idle period is carried out at the refresh rate in conformity to an image to be displayed, there are generally 3 methods of reducing the power consumption by reducing the signal delay while keeping the quality of the image to be displayed, namely:

① thickly forming a metal film of which the signal lines 12 and 16 are made;

② widening the widths of the space between the signal lines 12 and 16; and ③ widening the width of the space between two neighboring scanning signals 12 or widening the width between two neighboring gray scale signal lines 16, so as to reduce the load-carrying capacitance of the signal lines 12 and 16.

However, in the method ①, the formation of the metal take long so that the productivity is decreased, and also it becomes difficult to control the process of etching on the occasion of forming the metal layer so that the yield ratio is decreased and the costs are driven up.

In the methods ② and ③, the area of a picture element through which light permeates is reduced and hence the open area ratio decreases. The open area ratio is a ratio of an opened part, i.e. the part which light permeates, to the rest of the area of the picture element. On this account, the luminosity of the display panel decreases so that the display quality is degraded.

On the contrary, using the LCD device with the opposed matrix stricture in which the load-carrying capacitance (capacitance on the signal lines 12 and 16) is small, it is possible to quickly supply the data signal to the pixel electrodes 14 and the scanning period (i.e. the writing period in FIG. 1) can be shortened.

On this account, while keeping the length of the vertical period unchanged, i.e. keeping the refresh rate unchanged, the idle period in one vertical period can be extended. In other words, it is possible to provide the idle period which is a non-scanning period longer than the scanning period for scanning the screen once and able to cause all of the scanning signal lines to be in the state of non-scanning. This makes it possible to reduce the power consumption without degrading desired display quality.

As described above, the LCD device illustrated in FIG. 2 is driven by a driving method arranged in such a manner that a plurality of rows, which are on the screen on which pixels are provided in a matrix manner, are sequentially selected so as to be scanned via a plurality of scanning signal lines 12 formed on a substrate 10, then a data signal is supplied to the pixels on the selected rows via gray scale signal lines 16 formed on a counter substrate 15 facing the substrate 10, wherein an idle period is longer than a scanning period for scanning the screen once and is able to cause all of the scanning signal lines to be in the state of non-scanning, and one scanning period and one idle period consist of one vertical period.

In this method, the write period during which period the data signal is supplied to all pixels on the screen is a scanning period during which period always one of the scanning signal lines is in the state of scanning, and the interval between the end of the write period and the start of the next scanning of the screen is an idle period.

With this arrangement, a display device with the counter matrix structure, in which the gray scale signal lines 16 are formed on the counter substrate 15 so that the scanning signal lines 12 do not intersect with the gray scale signal lines 16 on the substrate 10, is provided with an idle period which is longer than a scanning period for scanning the screen once and is able to cause all of the scanning signal lines to be the state of non-scanning, and one scanning period and one idle period consist of one vertical period.

When adopting the counter matrix structure, the scanning signal lines 12 intersect with the gray scale signal lines 16 neither on the substrate 10 nor the counter substrate 15, so that there is no load-carrying capacity which is generated where the lines are intersected, and hence the load-carrying capacitance of the scanning signal lines 12 and the gray scale signal lines 16 is small so that the signal delay is restrained.

As a result, the scanning period in the write period for supplying the data signal can be shortened so that it is possible to raise the proportion of the scanning period in one vertical period. In other words, the idle period can be arranged so as to be longer than the scanning period for scanning the screen once.

Thus, since the length of one vertical period stay the same even if the idle period is extended, the refresh rate is not lowered. For this reason, the response to the change of the display is not slowed down and the extension of the idle period makes it possible to reduce the power consumption.

This realizes sufficient reduction of the power consumption without the degradation of the display qualities such as brightness, contrast, and responsiveness.

By the way, the arrangement of the scanning period in the write period, i.e. a supply rate (writing rate) of the data signal to the pixel electrodes 14 can be arbitrarily set by the control circuit 75 illustrated in FIG. 17.

Figure 7:
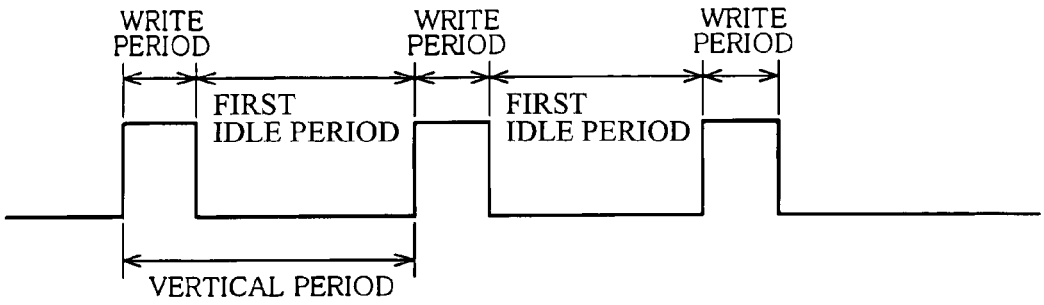
FIG. 7 illustrates a driving method of an LCD device, provided that a write period and an idle period of the device are half as much as those of the LCD device of the comparative example.

Moreover, as FIG. 7 illustrates, provided that the write period (scanning period) and the first idle period are half as much as those of the comparative example so that one vertical period is half as much as that of the comparative example, one vertical period of the comparative example is equal to 2 vertical periods of the arrangement illustrated in FIG. 7. With this arrangement, it is possible to provide 2 write periods during the time equivalent to one vertical period of the comparative example, and hence the refresh rate can be double as much as the rate in the comparative example, thereby the response rate to the change of the display is doubled, compared to the response rate in the case of the comparative example.

With this arrangement, it is possible to increase the refresh rate without increasing the power consumption, and thus the display qualities can be enhanced.

Incidentally, the driving method described above can be adopted to not only the transmissive display device but also a reflective LCD device and a reflective-cum-transmissive LCD device.

Moreover, it is unnecessary to adopt any particular method to supply a voltage to the pixel electrodes 14, and hence methods such as a voltage modulation method and a phase modulation method may be adopted.

Furthermore, the switching element is not necessarily the TFT 11, thus, for instance, an MIM (Metal Insulator Metal) which is an element with 2 terminals may be adopted.

[Embodiment 2]

Figure 8:
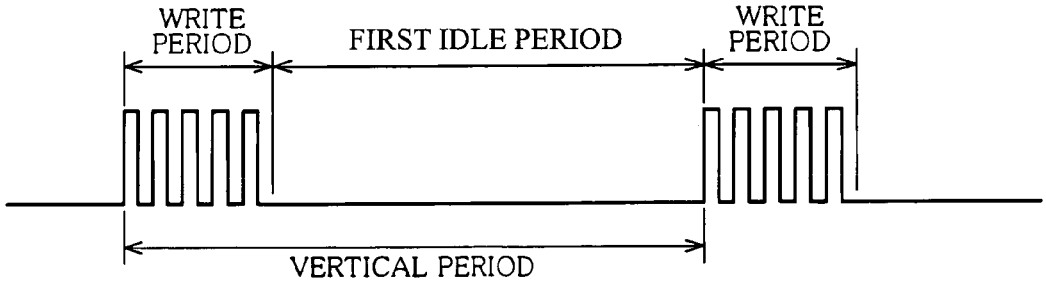
FIG. 8(*a*) illustrates a driving method of an LCD device in accordance with another embodiment of the present invention.
Figure 8:
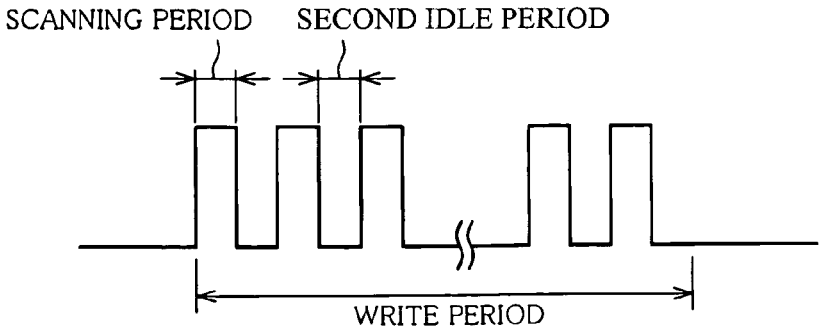

The following description will discuss another embodiment in accordance with the present invention in reference to FIGS. 2 and 8(*a*)–9. By the way, members having the same functions as those described in Embodiment 1 are given the same numbers, so that the descriptions are omitted for the sake of convenience.

An LCD device in accordance with the present embodiment has an arrangement identical with the LCD device of Embodiment 1 (cf. FIG. 2).

The following description relates to another driving method of the LCD device (display device), in which a scanning method in a write period for scanning the screen once is short.

As illustrated in FIGS. 8(*a*) and 8(*b*), a write period (data write period) has second idle periods along with scanning periods. In this case, as FIG. 8(*a*) shows, the length of the write period and the length of a first idle period after the write period are identical with the write period and the first idle period in the comparative example of Embodiment 1 illustrated in FIG. 4, respectively.

Here, as indicated in FIG. 8(*b*), the second idle periods are provided in the write period so that one write period is arranged such that, for instance, the scanning periods and the second idle periods are alternately provided corresponding to each scanning of a row, and hence the length of the idle periods in total in one vertical period is longer than the idle period in the comparative example, by the second idle periods in the write period.

That is, thanks to the counter matrix structure, it is possible to shorten the scanning period(s) in the write period, and the rest of the write period can be used as the idle periods.

In this manner, the write period during which period a data signal is supplied to all pixels in the screen is arranged so that the scanning periods, during which periods one of the scanning signal lines 12 is in the state of scanning, and the second idle periods are alternately provided, and after the finish of the write period, the first idle period continues until the start of the next scanning of the screen.

As a result, the write period has the first idle periods corresponding to respective scannings of lines.

On this account, it is possible to extend the idle periods (first and second idle periods) in total without extending the vertical period, i.e. it is possible to set the idle periods longer than the scanning periods for scanning the screen once. Also, even if the idle periods are extended, the length of one vertical period remains unchanged.

Consequentially, it is possible, for instance, to reduce the power consumption of the LCD device without causing the degradation of display qualities such as brightness, contrast, and responsiveness.

Figure 9:
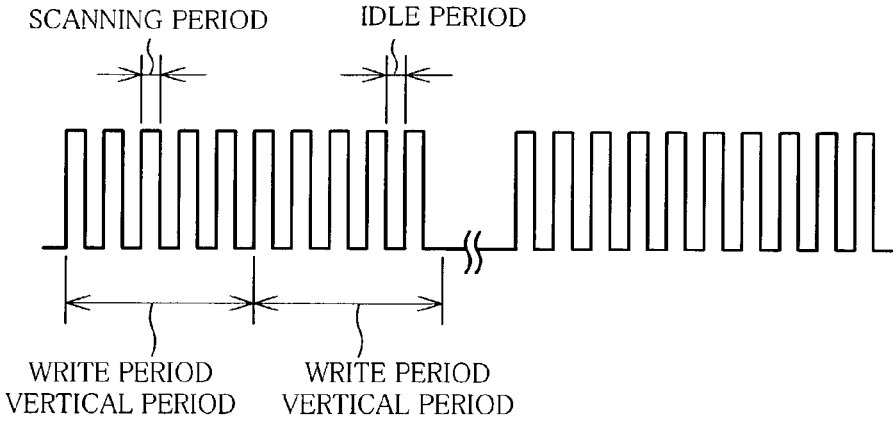
FIG. 9 shows a driving method of an LCD device, provided that the entirety of one vertical period is the write period, and the scanning period and the idle period are alternately provided in the write period.
Figure 10:
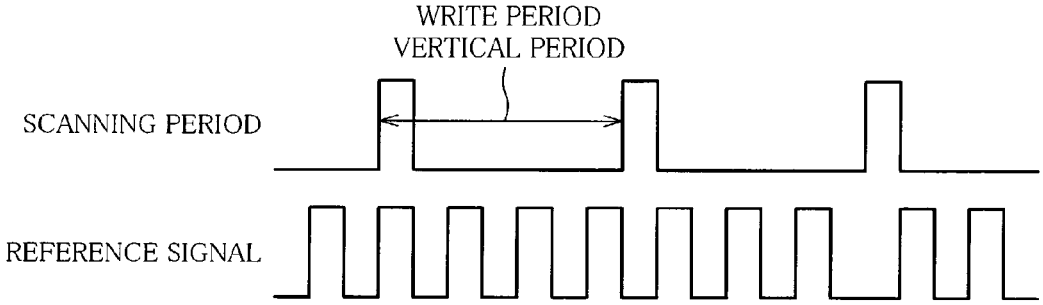
FIG. 10 illustrates a driving method of an LCD device in accordance with a further arrangement of the present invention.

An alternative arrangement is such that, as illustrated in FIG. 9, the whole of one vertical period is set as a write period, and scanning periods and idle periods are, for instance, alternately provided corresponding to each scanning of a row.

That is to say, the idle periods, (i) which are longer than the scanning periods during which periods the screen is scanned once and (ii) during which periods all of the scanning signal lines are in the state of non-scanning, and the scanning periods, during which period one of the scanning signal lines 12 is in the state of scanning, are alternately provided, so that vertical period consists of the idle periods and the scanning periods.

Also in this case, the scanning periods in the write period can be made shorter thanks to the counter matrix structure, and hence the rest of the write period can be used as the idle periods.

On this account, it is possible to extend the idle periods without extending the vertical period. That is to say, the idle periods can be made longer than the scanning periods through which periods the screen is scanned once. Moreover, since the extension of the idle periods can be done with the length of the vertical period unchanged, it is possible to prevent the decrease of the refresh rate. In other words, it is possible to provide the idle periods without lowering the refresh rate from a regular rate (50–70 Hz, for instance) at all.

This makes it possible to realize the reduction of the power consumption with sufficient moving image qualities, i.e. without the degradation of display qualities.

[Embodiment 3]

Referring to FIGS. 2, 3, and 10 through 17, the following description will discuss a further embodiment in accordance with the present invention. By the way, members having the same functions as those described in Embodiment 1 are given the same numbers, so that the descriptions are omitted for the sake of convenience.

An LCD device in accordance with the present embodiment has an arrangement identical with the LCD device of Embodiment 1 (cf. FIG. 2).

The following description relates to a further driving method of the LCD device (display device), in which a scanning method in a write period for scanning the screen once is short.

As in Embodiment 1, the LCD device of the present embodiment adopts the counter matrix structure so that the write period thereof is shorter than that of the LCD device (cf. FIG. 3) in which the gray scale signal lines 16 and the scanning signal lines 12 are provided on the same substrate, even if the amount of the data is the same.

Now, referring to FIGS. 12 and 13, what is described below is another driving method of the LCD device (of the comparative example) illustrated in FIG. 3, in which the gray scale signal lines 16 and the scanning signal lines 12 are provided on the same substrate.

Figure 12:
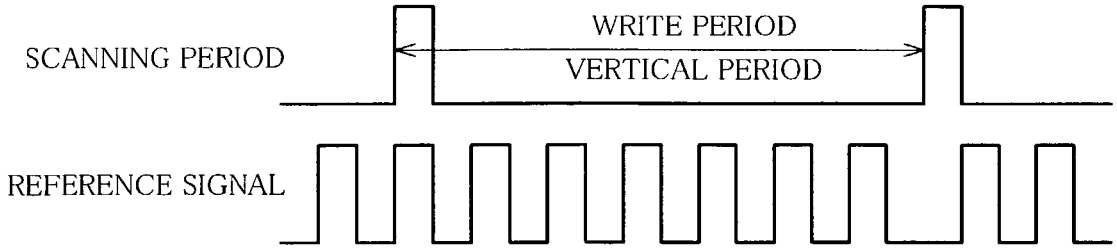
FIG. 12 illustrates another driving method of the LCD device of the comparative example shown in FIG. 3.

As FIG. 12 indicates, no idle period is provided in the vertical period of the present embodiment.

In the arrangement of the comparative example illustrated in FIG. 3, an additional capacitance 30 keeps a voltage supplied to a liquid crystal layer. Also, one electrode constituting the additional capacitance 30 is a pixel electrode 14, while the other electrode constituting the additional capacitance 30 is connected to a reference signal line 13. Here, a voltage supplied from the reference signal line 13 is a reference signal, and a gate voltage supplied to the scanning signal line 12 in order to turn ON or OFF a TFT 11 is a scanning signal.

That is to say, in one frame period (one vertical period) during which period the whole screen is scanned once, a pixel voltage is kept in the additional capacitance 30 so that the liquid crystal has been driven, until the next gate voltage (scanning signal) is supplied. Incidentally, one frame period in this embodiment is a period required for scanning one display from top to bottom.

Figure 13:
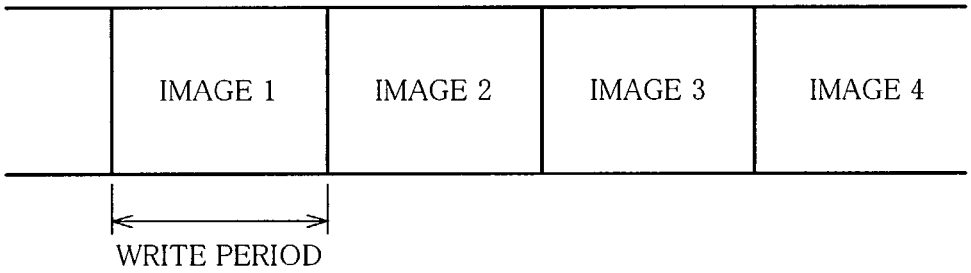
FIG. 13 indicates the variation of the types of images which are written during the write period of the driving method shown in FIG. 12.

FIG. 13 indicates the variation of the types of images which are written during the write period (one vertical period). Thus, as the figure shows, an image to be written varies in each write period, i.e. one vertical period.

In this case, provided that the supply frequency of the data signal is N(Hz), N images are displayed on the screen in one second. In other words, provided that the supply frequency of the data signal is N(Hz), the time required for writing one image is 1/N (second), i.e. the screen is scanned once during the period of 1/N (second). Provided that the number of the scanning signal lines 12 is j, a scanning period for scanning one line, i.e. one vertical period in this embodiment is equivalent to 1/(N·j) (second).

In the meantime, a driving method of the LCD device in accordance with the present embodiment is arranged in such a way that no idle period is provided as in the case of the comparative example and the write period is shorter than that of the comparative example. In this driving method, for instance, since the write period of this embodiment is half as much as the same of the comparative example, as FIG. 10 indicates, two write periods are provided during the period of (1/(N·j) (second)) which is equivalent to one vertical period of the comparative example. Here, the images (images to be displayed) which are written during these two write periods, i.e. the data signal are identical with each other, as indicated in FIG. 11.

In the LCD device illustrated in FIG. 2, a pixel voltage supplied to the reference signal lines 13 is a reference signal, and a gate voltage supplied to the scanning signal lines 12 is a scanning signal.

Figure 11:
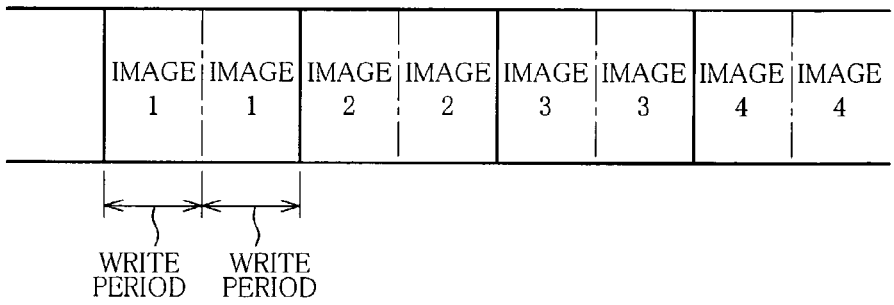
FIG. 11 indicates the variation of the types of images which are written during the write period of the driving method shown in FIG. 10.

In this manner, as illustrated in FIG. 11, provided that the write period is shortened so that two write periods are provided within the time for one write period of the comparative example and the same image is written during both of these two write periods, the time for keeping a voltage applied to the liquid crystal layer (liquid crystal voltage) is half as much as the same of the comparative example.

That is to say, since an image is written more than once, the time for keeping the liquid crystal voltage is shortened, and hence the degradation of the display qualities (such as flicker in screen) due to the decrease of the rate of keeping the liquid crystal voltage can be prevented. On this account, it is possible to increase the display qualities of the LCD device.

As described above, provided that the supply frequency of the data signal is N(Hz) and the number of the scanning signal lines is j, the supply of the data signal to pixels in the row selected by the scanning signal lines 12 is carried out more than once during the period of 1/(N·j) (second). It is preferable that every time the same data signal is supplied to the pixels in the screen scanned during the period of 1/(N·j) (second).

On this account, the same image is written more than once so that the write period is repeated more than once.

Thus the time for keeping the liquid crystal voltage (light modulating layer voltage) is shortened so that the degradation of the display quality (such as flicker in screen) due to the decrease of the rate of keeping the liquid crystal voltage can be prevented.

Figure 16:
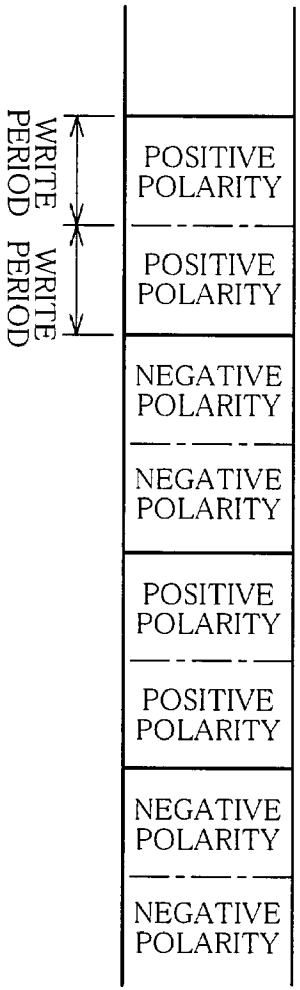
FIG. 16 illustrates the polarity of an electric potential on the occasion of writing identical images, provided that the polarity of the electric potential supplied to the pixel electrodes is not inverted.

Incidentally, in the present embodiment, the polarity of an electric charge supplied to the pixel electrodes 14 during the scanning period (the polarity of an electric charge supplied to the liquid crystal layer, i.e. the polarity of the reference signal) is constant on the occasion of writing the same image (data signal) during the period of (N·j) (second), as indicated in FIG. 16.

Figure 14:
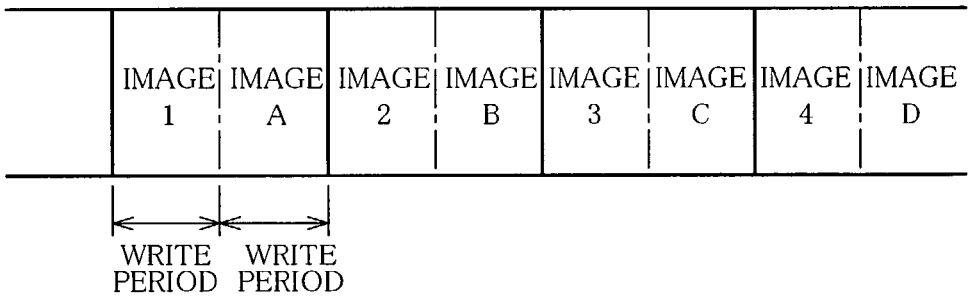
FIG. 14 indicates the variation of the types of images which are written during the write period of the driving method shown in FIG. 10, provided that an image and a non-display image are alternately written.

Alternatively, as FIG. 14 indicates, instead of writing the same image, two different images, for instance, the image (images 1, 2, . . . ) in the comparative example illustrated in FIG. 13 and a non-display image such as a solidly shaded image (images A, B, . . . ) may be written during the period of (1/(N·j) (second)) which is equivalent to the write period of the comparative example.

That is, provided that the write period, i.e. one vertical period is half as much as the same of the comparative example, two write periods are provided during the period of (1/(N·j) (second)) which is equivalent to the write period of the comparative example, and the image (image to be displayed) to be written during the respective write periods may be different images (an image and a non-display image, for instance).

In this manner, it is preferable that at least two types of data signals are supplied to the pixels of the screen within the period of 1/(N·j) (second), when the pixels are scanned during the period of 1/(N·j) (second), and at least once in a plurality of scannings, an identical non-scanning image, in which all data signals supplied to the pixels are identical, is written.

The display is carried out with a non-display image being inserted between images so that it is possible to realize an impulse-type driving, which is typified by CRTs (Cathode Ray Tubes), rather than a hold-type driving which is particularly adopted in LCD devices.

Thus, using the LCD device, it is possible to display moving images requiring to display a lot of images, and hence an active matrix LCD device with sufficient moving image qualities can be realized.

Figure 15:
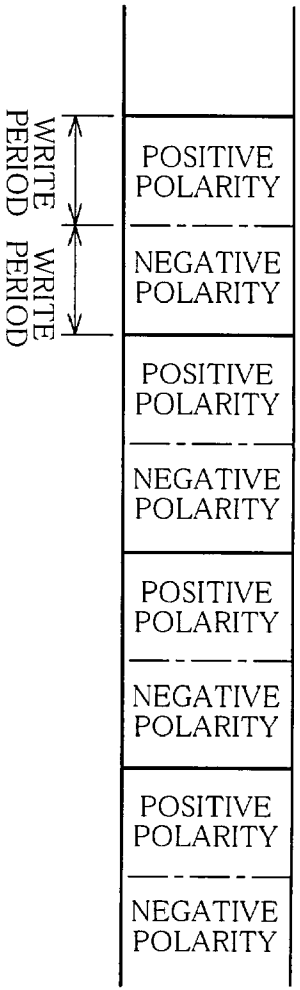
FIG. 15 indicates the variation of polarity, provided that the polarity of an electric potential supplied to pixel electrodes is repeatedly inverted.

Alternatively, in the arrangements illustrated in FIGS. 11 and 14, the polarity of an electric charge supplied to the pixel electrodes 14 may be alternately diverted, as illustrated in FIG. 15.

In this case, the inversion frequency is doubled, and this increase of the inversion frequency enables to reduce the flicker in screen due to the difference between an image of the positive polarity and an image of the negative polarity.

Provided that the write period is half as much as that of the comparative example and the frequency is 60 Hz, the inversion frequency is doubled so as to be 120 Hz, so that the flicker is invisible for human eyes.

As described above, during the period of 1/(N·j) (second), each time the data signal is supplied to the pixels on the row selected by the scanning signal lines 12, the polarity of the electric charge supplied to the pixels is inverted, so that the inversion frequency can be increased and the flicker in screen, due to the difference between an image of the positive polarity and an image of the negative polarity, is restrained. On this account, it is possible to improve the display qualities of the LCD device.

Moreover, repeating the polarity inversion makes it possible to restrain the adhesion of ionic substances on the channels of the respective TFTs 11. This enables to restrain the defects caused by the degradation of the characteristics of the TFTs 11, and hence an LCD device with high reliability can be provided.

Incidentally, the types of images to be written (types of data signals to be supplied) and the polarity of the electric charge supplied to the pixels are controlled by the control circuit (control means) 75 which is illustrated in FIG. 17.

As described above, the driving method of the display device in accordance with the present invention includes the steps of: sequentially scanning rows on a screen on which pixels are provided in a matrix manner, by scanning signal lines formed on a substrate; and supplying a data signal to pixels on a row which has been selected, from data signal lines formed on a counter substrate which faces the substrate, the driving method being characterized in that, a first idle period (i) which is longer than a data write period for scanning the screen once and (ii) during which period all scanning signal lines are in a state of non-scanning, is provided, and the data write period and the idle period constitute one vertical period.

According to this arrangement, the display device with the counter matrix structure, in which the data signal lines are formed on the counter substrate and the scanning signal lines and the data signal lines do not intersect with each other on the same substrate, is arranged in such a manner that the first idle period, (1) which is longer than the data write period for scanning all of the pixel electrodes and (2) during which period all scanning signal lines are in a state of non-scanning, is provided, and the data write period and the idle period constitute one vertical period.

Moreover, with the counter matrix structure, since the scanning signal lines and the data signal lines do not intersect with each other on the same substrate, the load-carrying capacitance, which is generated when the lines intersect with each other, is not generated. On this account, the load-carrying capacitance of the scanning signal lines and that of the data signal lines are small so that the signal delay is restrained.

Consequently, it is possible to shorten the scanning period in the write period for supplying the data signal, and on account of this, it is possible to extend the idle period without extending the vertical period. In other words, it is possible to make the idle period longer than the scanning period for scanning the screen once.

Since the length of one vertical period remains unchanged even if the idle period is extended, the refresh rate is not lowered. For this reason, the response to the change of the display is not slowed down and the extension of the idle period makes it possible to reduce the power consumption.

This realizes sufficient reduction of the power consumption without causing the degradation of the display qualities such as brightness, contrast, and responsiveness.

The aforementioned driving method of the display device is preferably arranged so that a data write period, during which period the data signal is supplied to all of the pixels on the screen, is the scanning period during which period one of the scanning lines is always in a state of scanning, and a period between finish of the data write period and start of next scanning of the screen is the idle period.

According to this arrangement, vertical periods, each including the scanning period and the idle period which is longer than the scanning period and causes all scanning signal lines to be in the state of non-scanning, are repeated.

On this account, since the scanning period is shortened, it is possible to extend the idle period without changing the length of the vertical period. In other words, it is possible to make the idle period longer than the scanning period for scanning the screen once. This makes it possible to realize sufficient reduction of the power consumption without causing the degradation of display qualities.

Moreover, since the length of one vertical period remains unchanged even if the idle period is extended, it is possible to restrain the drop of the refresh rate.

The aforementioned driving method of the display device is preferably arranged such that a data write period is composed of scanning periods during which periods one of the scanning signal lines is always in the state of scanning and idle periods, the scanning periods and the idle periods being alternately provided, and a period between the end of the data write period and the start of the next scanning of the screen is an idle period.

According to this arrangement, each of the idle period is provided corresponding to each scanning of a row.

This enables to extend the idle periods in one vertical period, i.e. it is possible to make the idle periods longer than the scanning periods for scanning the screen once. Also, since the length of one vertical period remains unchanged even if the idle periods are extended, it is possible to restrain the lessening of the refresh rate.

On this account, it is possible to realize sufficient reduction of the power consumption without causing the degradation of display qualities.

Furthermore, the driving method of the display device in accordance with the present invention includes the steps of: sequentially scanning rows on a screen on which pixels are provided in a matrix manner, by scanning signal lines formed on a substrate; and supplying a data signal to pixels on a row which has been selected, from data signal lines formed on a counter substrate which faces the substrate, the driving method being characterized in that, idle periods, (I) which are longer than scanning periods for scanning the screen once and (II) during which periods all scanning signal lines are in a state of non-scanning, and the scanning periods, during which periods one of the scanning lines is always in a state of scanning, are alternately provided, and the scanning periods and the idle periods constitute one vertical period.

According to this arrangement, in the data write period, each of the idle periods corresponds to each scanning of a row.

This enables to extend the idle periods without extending the length of one vertical period, i.e. it is possible to make the idle periods longer than the scanning periods for scanning the screen once. Also, since the length of one vertical period remains unchanged even if the idle periods are extended, it is possible to restrain the lessening of the refresh rate. Thus the idle periods can be provided without lowering the refresh rate from a regular rate (50–70 Hz, for instance) at all.

This makes it possible to realize the reduction of the power consumption while keeping sufficient moving image qualities, i.e. without the degradation of display qualities.

Furthermore, the driving method of the display device in accordance with present invention includes sequentially scanning rows on a screen on which pixels are provided in a matrix manner, by scanning signal lines formed on a substrate; and supplying a data signal to pixels on a row which has been selected, from data signal lines formed on a counter substrate which faces the substrate, the driving method being characterized in that, when supply frequency of the data signal is N(Hz) and j scanning signal lines are provided, during a period of $1/(N \cdot j)$ (second), the data signal is supplied to the pixels, which are on the row which has been selected, more than once.

According to this arrangement, the scanning is carried out more than once during the period of 1/(N·j) (second) so that, for instance, the same image is written more than once.

That is to say, more than one write periods are repeated during the period of 1/(N·j) (second), and hence the time for keeping the voltage (light modulating layer voltage) supplied to the light modulating layer is shortened.

This results in the prevention of the degradation of display qualities (such as generation of flicker) due to the decrease of the rate of keeping the light modulating layer voltage. On this account, it is possible to, for instance, improve the display qualities of the display device.

The aforementioned driving method of the display device is preferably arranged such that pixels on the screen, the pixels being scanned during the period of 1/(N·j) (second), always receive an identical data signal.

According to this arrangement, since the same data signal is supplied, i.e. the same image is written more than once, the write period is repeated more than once.

Thus, the time for keeping the light modulating layer voltage is shortened, and this results in the prevention of the degradation of display qualities (such as generation of flicker) due to the decrease of the rate of keeping the light modulating layer voltage. On this account, it is possible to, for instance, improve the display qualities of the display device.

The aforementioned driving method of the display device is preferably arranged such that pixels on the screen, the pixels being scanned during the period of 1/(N·j) (second), receive more than one type of data signals during the period of 1/(N·j) (second).

For instance, it is preferable that at least one scanning among sequential scannings is carried out for writing a non-display image by which all of the pixels receive an identical data signal.

According to these arrangements, for instance, the display is carried out with a non-display image being inserted between images so that it is possible to realize an impulse-type driving, which is typified by CRTs, rather than a hold-type driving which is particularly adopted in LCD devices.

Thus, using the LCD device, it is possible to display moving images requiring to display a lot of images, and hence an active matrix LCD device with sufficient moving image qualities can be realized.

The aforementioned driving method of the display device is preferably arranged such that during the period of 1/(N·j) (second), each time the data signal is supplied to the pixels on the row which has been selected, polarity of an electric potential supplied to the pixels is inverted.

According to this arrangement, the increase of the inversion frequency is realized and this enables to make the flicker, which is generated due to the difference between an image of the positive polarity and an image of the negative polarity, to be invisible for human eyes.

Since the flicker becomes invisible, it is possible to improve display qualities of the display device.

Moreover, repeating the polarity inversion makes it possible to restrain the adhesion of ionic substances on the channels of the switching element. This enables to restrain the defects caused by the degradation of the characteristics of the switching element, and hence a display device with high reliability can be provided.

The display device in accordance with the present invention is characterized by including control means for carrying out the aforementioned driving methods of the display device.

According to this arrangement, it is possible to shorten the scanning period in the write period for supplying the data signal, and on account of this, it is possible to extend the idle period without extending the vertical period. In other words, it is possible to make the idle period longer than the scanning period for scanning the screen once.

Since the length of one vertical period remains unchanged even if the idle period is extended, the refresh rate is not lowered. For this reason, the response to the change of the display is not slowed down and the extension of the idle period makes it possible to reduce the power consumption.

This realizes sufficient reduction of the power consumption without causing the degradation of the display qualities such as brightness, contrast, and responsiveness.

Also, provided that the supply frequency of the data signal is N(Hz) and the number of the scanning signal lines is j, the write period is provided more than once during the period of 1/(N·j) (second) so that the time for keeping a voltage (light modulating layer voltage) supplied to the liquid crystal layer is shortened.

This results in the prevention of the degradation of display qualities (such as generation of flicker) due to the decrease of the rate of keeping the light modulating layer voltage. On this account, it is possible to, for instance, improve the display qualities of the display device.

The display device in accordance with the present invention includes: pixel electrodes provided in a matrix manner; switching elements connected to the respective pixel electrodes; a substrate on the side of the switching elements, on which scanning signal lines which control the switching elements by scanning so as to select the pixel electrodes are provided; and a counter substrate which faces the substrate via a light modulating layer, on the counter substrate, data signal lines, which are for supplying a data signal to pixels corresponding to the pixel electrodes which have been selected, being provided, the display device being characterized by: control means for establishing an arrangement such that an idle period, (1) which is longer than a scanning period for scanning all of the pixel electrodes and (2) during which period all scanning signal lines are in a state of non-scanning, is provided, and the scanning period and the idle period constitute one vertical period.

According to this arrangement, the display device with the counter matrix structure, in which the data signal lines are formed on the counter substrate and the scanning signal lines and the data signal lines do not intersect with each other on the same substrate, is arranged in such a manner that a first idle period, (1) which is longer than the data write period for scanning all of the pixel electrodes and (2) during which period all scanning signal lines are in a state of non-scanning, is provided, and the data write period and the idle period constitute one vertical period.

With the counter matrix structure, since the scanning signal lines and the data signal lines do not intersect with each other on the same substrate, the load-carrying capacitance, which is generated when the lines intersect with each other, is not generated. On this account, the load-carrying capacitance of the scanning signal lines and that of the data signal lines are small so that the signal delay is restrained.

Consequently, it is possible to shorten the scanning period in the write period for supplying the data signal, and on account of this, it is possible to extend the idle period without extending the vertical period.

Since the length of one vertical period remains unchanged even if the idle period is extended, the refresh rate is not lowered. For this reason, the response to the change of the display is not slowed down and the extension of the idle period makes it possible to reduce the power consumption.

This realizes sufficient reduction of the power consumption without causing the degradation of the display qualities such as brightness, contrast, and responsiveness.

The display device in accordance with the present invention includes: pixel electrodes provided in a matrix manner; switching elements connected to the respective pixel electrodes; a substrate on the side of the switching elements, on which scanning signal lines which control the switching elements by scanning so as to select the pixel electrodes are provided; and a counter substrate which faces the substrate via a light modulating layer, on the counter substrate, data signal lines, which are for supplying a data signal to pixels corresponding to the pixel electrodes which have been selected, being provided, the display device being characterized by including: control means for controlling the scanning signal lines and the data signal lines in order to establish an arrangements such that, when supply frequency of the data signal is N(Hz) and j scanning signal lines are provided, during a period of 1/(N·j) (second), the data signal is supplied to the pixels, which have been selected by the scanning signal lines, more than once.

According to this arrangement, carrying out the scanning more than once in the period of 1/(N·j) (second) enables to provide more than one write period, i.e. to repeat the writing of the image (data signal) more than once. As a result, the time for keeping a voltage (light modulating layer voltage), which is supplied to the light modulating layer, is shortened.

This results in the prevention of the degradation of display qualities (such as generation of flicker) due to the decrease of the rate of keeping the liquid modulating layer voltage. On this account, it is possible to improve the display qualities of the display device.

The aforementioned display device is preferably arranged such that during the period of 1/(N·j) (second), each time the data signal is supplied to the pixels which have been selected, polarity of an electric potential supplied to the pixels is inverted.

According to this arrangement, the increase of the inversion frequency is realized and this enables to make the flicker, which is generated due to the difference between an image of the positive polarity and an image of the negative polarity, invisible for human eyes.

Since the flicker becomes invisible, it is possible to improve display qualities of the display device.

Moreover, repeating the polarity inversion makes it possible to restrain the adhesion of ionic substances on the channels of the switching element. This enables to restrain the defects caused by the degradation of the characteristics of the switching element, and hence a display device with high reliability can be provided.

The display device in accordance with the present invention is preferably arranged such that the light modulating layer is either a liquid crystal layer or an electro luminescence layer.

According to this arrangement, it is possible to provide an LCD device or an electroluminescence display device, which consumes a small amount of electricity, without causing the degradation of the display qualities.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A driving method of a display device, comprising the steps of:

sequentially selecting so as to scan rows on a screen on which pixels are provided in a matrix manner, by scanning signal lines formed on a substrate; and supplying a data signal to pixels on a row which has been selected, from data signal lines formed on a counter substrate which faces the substrate, wherein, a first idle period (i) which is longer than a data write period for scanning the screen once and (ii) during which period all scanning signal lines are in a state of non-scanning, is provided, and the data write period and the idle period constitute one vertical period.

2. The driving method of the display device as defined in claim 1, wherein the data write period, during which period the data signal is supplied to all of the pixels on the screen, comprises a scanning period during which period one of the scanning lines is in a state of scanning, and a period between finish of the data write period and start of next scanning of the screen is the first idle period.

3. A driving method of a display device, comprising the steps of:

sequentially selecting so as to scan rows on a screen on which pixels are provided in a matrix manner, by scanning signal lines formed on a substrate; and supplying a data signal to pixels on a row which has been selected, from data signal lines formed on a counter substrate which faces the substrate, wherein:

a data write period, during which period the data signal is supplied to all of the pixels on the screen, is arranged in such a manner that scanning periods, during which periods one of the scanning lines is in a state of scanning, and second idle periods, during which periods all of the scanning signal lines are in a state of non-scanning, are alternately provided;

a period between finish of the data write period and start of next scanning of the screen is a first idle period during which period all of the scanning signal lines are in the state of non-scanning;

the scanning periods in total are shorter than a sum of the second idle periods in total and the first idle period; and the scanning periods, the second idle periods, and the first idle period constitute one vertical period.

4. A driving method of a display device, comprising the steps of:

sequentially selecting so as to scan rows on a screen on which pixels are provided in a matrix manner, by scanning signal lines formed on a substrate; and supplying a data signal to pixels on a row which has been selected, from data signal lines formed on a counter substrate which faces the substrate, wherein:

a first idle period, (I) which is longer than a data write period for scanning the screen once and (II) during which period all scanning signal lines are in a state of non-scanning, and the data write period, during which period one of the scanning lines is in a state of scanning, are alternately provided; and the data write period and the idle period constitute one vertical period.

5. A display device, comprising:

pixel electrodes provided in a matrix manner;

switching elements connected to the respective pixel electrodes;

a substrate on the side of the switching elements, on which scanning signal lines which control the switching elements by means of scanning so as to select the pixel electrodes are provided; and a counter substrate which faces the substrate via a light modulating layer, on the counter substrate, data signal lines, which are for supplying a data signal to pixels corresponding to the pixel electrodes which have been selected, being provided, the display device further comprising:

control means for establishing an arrangement such that a first idle period, (1) which is longer than a data write period for scanning all of the pixel electrodes and (2) during which period all scanning signal lines are in a state of non-scanning, is provided, and the data write period and the idle period constitute one vertical period.

6. The display device as defined in claim 5, wherein the light modulating layer is either a liquid crystal layer or an electroluminescence layer.

7. The display device as defined in claim 5, wherein:

a period for supplying the data signal to all of the pixel electrodes is a data write period;

this data write period comprises a scanning period during which period one of the scanning lines is in a state of scanning; and a period between finish of the data write period and start of next scanning of the pixel electrodes is the idle period.

8. A display device, comprising:

pixel electrodes provided in a matrix manner;

switching elements connected to the respective pixel electrodes;

a substrate on the side of the switching elements, on which scanning signal lines which control the switching elements by means of scanning so as to select the pixel electrodes are provided;

a counter substrate which faces the substrate via a light modulating layer; and data signal lines on the counter substrate, for supplying a data signal to pixels corresponding to the pixel electrodes which have been selected, the display device further comprising control means:

(a) for alternating scanning periods and second idle periods in a data write period during which period the data signal is supplied to all of the pixel electrode, in the scanning periods one of the scanning signal lines being in a state of scanning, and in the second idle periods all of the scanning signal lines being in a state of non-scanning;

(b) for setting a first idle period between finish of the data write period and start of next scanning of the pixel electrodes, in the first idle period all of the scanning signal lines being in the state of non-scanning;

(c) for setting the scanning periods in total to be shorter than a sum of the second idle periods in total and the first idle period; and (d) for setting a sum of the canning periods, the first idle periods, and the second idle period to be one vertical period.

9. A display device, comprising:

pixel electrodes provided in a matrix manner;

switching elements connected to the respective pixel electrodes;

a substrate on the side of the switching elements, on which scanning signal lines which control the switching elements by means of scanning so as to select the pixel electrodes are provided; and a counter substrate which faces the substrate via a light modulating layer, on the counter substrate, data signal lines, which are for supplying a data signal to pixels corresponding to the pixel electrodes which have been selected, being provided, the display device further comprising:

control means for establishing arrangements such that the data write period, during which period one of the scanning signal lines is in a state of scanning, and first idle period, (I) which is no longer than the the data write period and (II) during which period all of the scanning signal lines are in a state of non-scanning, are alternately provided, and the data write period and the first idle period constitute one vertical period.

10. The display device as defined in claim 9, wherein the light modulating layer is either a liquid crystal layer or an electroluminescence layer.

* * * * *